United States Patent [19]

Bryant et al.

[11] 4,398,665

[45] Aug. 16, 1983

[54] APPARATUS FOR UNIFORMLY APPLYING EITHER LIQUID OR FOAM COMPOSITIONS TO A MOVING WEB

[75] Inventors: Clifford A. Bryant, Dalton; Gary M. Bearden, Varnell; Joseph A. Pacifici, La Grange, all of Ga.

[73] Assignee: West Point Pepperell, Inc., West Point, Ga.

[21] Appl. No.: 390,114

[22] Filed: Jun. 18, 1982

[51] Int. Cl.[3] ..... B05C 5/02

[52] U.S. Cl. ..... 239/193; 118/407; 118/325; 118/DIG. 4; 68/205 R

[58] Field of Search ..... 118/411, 412, 407, DIG. 4, 118/325; 156/78; 425/4 C, 817 C; 68/205 R; 427/420; 239/193, 590.5, 597, 598

[56] References Cited

U.S. PATENT DOCUMENTS

| | | |
|---|---|---|
| 2,253,060 | 8/1941 | Clearman . |
| 2,533,248 | 12/1950 | Helmus . |
| 3,042,573 | 7/1962 | Roberts . |
| 3,084,661 | 4/1963 | Roberts . |
| 3,969,780 | 7/1976 | Henderson . |
| 4,153,961 | 5/1979 | Cleveland . |
| 4,157,652 | 6/1979 | Mathes et al. . |
| 4,165,211 | 8/1979 | Ebeling et al. . |
| 4,222,342 | 9/1980 | Johansson et al. . |
| 4,254,644 | 3/1981 | Bartlett et al. . |
| 4,275,683 | 6/1981 | Kutz et al. . |
| 4,277,960 | 7/1981 | McKendrick et al. . |
| 4,297,860 | 11/1981 | Pacifici et al. . |

*Primary Examiner*—John P. McIntosh
*Assistant Examiner*—M. B. Calligaris
*Attorney, Agent, or Firm*—Cushman, Darby & Cushman

[57] ABSTRACT

Either foam or liquid is supplied under pressure to a distributor having a plurality of outlets each connected to a respective passageway extending along one side of a trough. Means are provided to combine the streams of material exiting the passageways prior to the material entering the trough. A curved blade is positioned along the opposite side of the trough. As the trough fills, an overflow of material passes over the crest of the blade and moves along the blade's curvature so as to be uniformly deposited on a web of material moving in a direction normal to the length of the trough.

9 Claims, 6 Drawing Figures

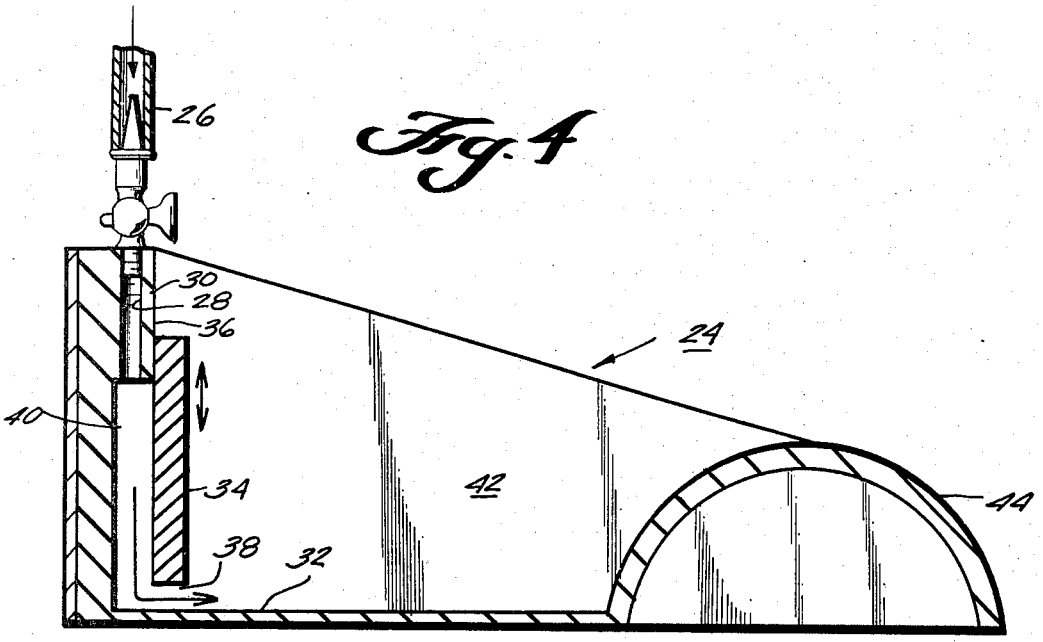
Fig. 4
Fig. 5
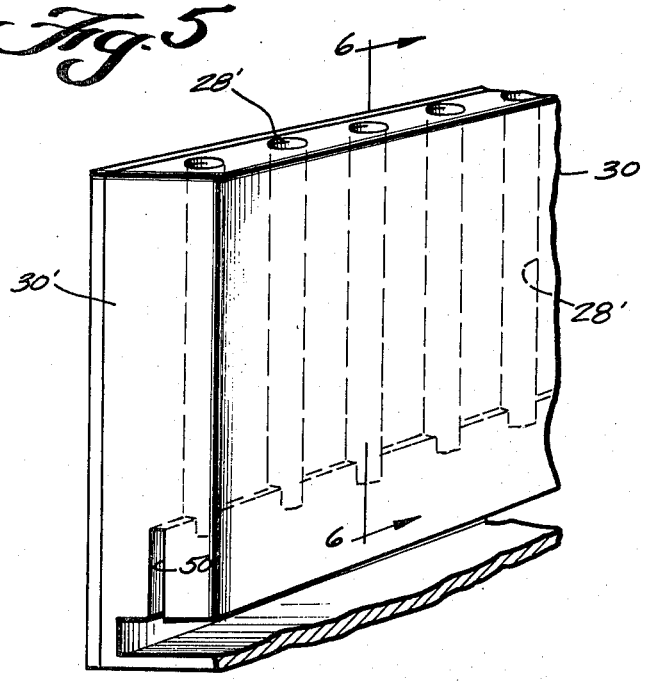
Fig. 6
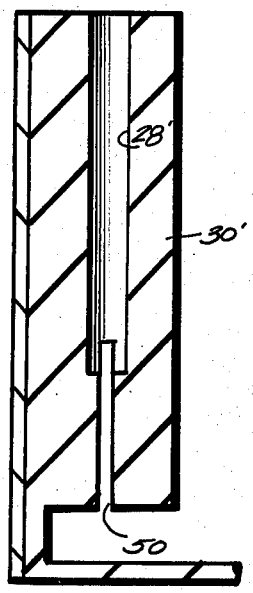

APPARATUS FOR UNIFORMLY APPLYING EITHER LIQUID OR FOAM COMPOSITIONS TO A MOVING WEB

BACKGROUND OF THE INVENTION

The problem of uniformly applying a liquid across a relatively wide, continuously moving web is addressed in U.S. Pat. No. 4,165,211 granted on Aug. 21, 1979. Disclosed in that patent is an arrangement in which a liquid formable reaction mix is supplied from a source to an elongated reservoir through a plurality of nozzles spaced therealong. When the liquid reaches a predetermined level in the reservoir, it overflows onto either an inclined plate or curved blade causing a film of the foamable reaction mix to be deposited onto the moving web passing underneath the plate or blade. Since the reservoir's width substantially corresponds to the width of the web, a uniform coating of the liquid mix is applied to the latter whereby a subsequent reaction produces a uniform foam layer on the web.

While the apparatus just described may be used to uniformly apply to a web a liquid which eventually will become foam, the applicator is not suitable for uniformly depositing form on the web, a procedure which is employed for such purposes as dyeing carpet. Instead, known methods of applying foam to a web have taken diverse forms, such as those disclosed in U.S. Pat. Nos. 4,275,683, issued on June 30, 1981, and 4,297,860, which granted on Nov. 3, 1981. The latter patent also mentions that previously known foaming techniques generally utilized metering rolls and/or doctor blades for achieving uniform distribution of the foam on the web.

Only a brief consideration of prior art foam applicators is required to appreciate that they are limited to the application of foam to a web. However, the present invention is characterized by its ability to uniformly apply either liquids or foam to moving webs of substantial widths. Accordingly, the invention is particularly suited for use in the carpet industry to apply dyes to carpet either as foam or as a liquid. This, of course, provides a decided economical advantage since the same equipment can be used for either type of operation.

SUMMARY OF THE INVENTION

Briefly, the invention comprises an arrangement wherein either foam or liquid is supplied under pressure to a distributor provided with a plurality of outlets connected by separate conduits to respective vertical passageways spaced along one side of a trough, or reservoir. Constricting means are provided at the lower ends of the passageways so that the streams of material exiting the passageways are merged prior to the material's entry into the trough. On the opposite side of the trough, a curved blade is provided. Once the trough fills, further material introduced to the trough causes an overflow to pass over the crest of the blade and be uniformly deposited onto a web which is moved in a direction normal to the length of the trough.

DETAILS OF THE INVENTION

The invention will be described in greater detail with respect to the accompanying drawings wherein:

FIG. 4 is an enlarged view in section of the foam applicator, taken along line 4—4 of FIG. 1;

FIG. 5 is a fragmented perspective view of an alternative embodiment of the foam applicator illustrated in FIGS. 1 and 4; and FIG. 6 is an enlarged view in section of the alternative embodiment of the foam applicator, taken along line 6—6 of FIG. 5.

Although the present invention is suitable for applying a uniform coating of either liquid or foam to a moving web, the initial discussion will be directed to its use in depositing foam onto the web.

Figure 1:
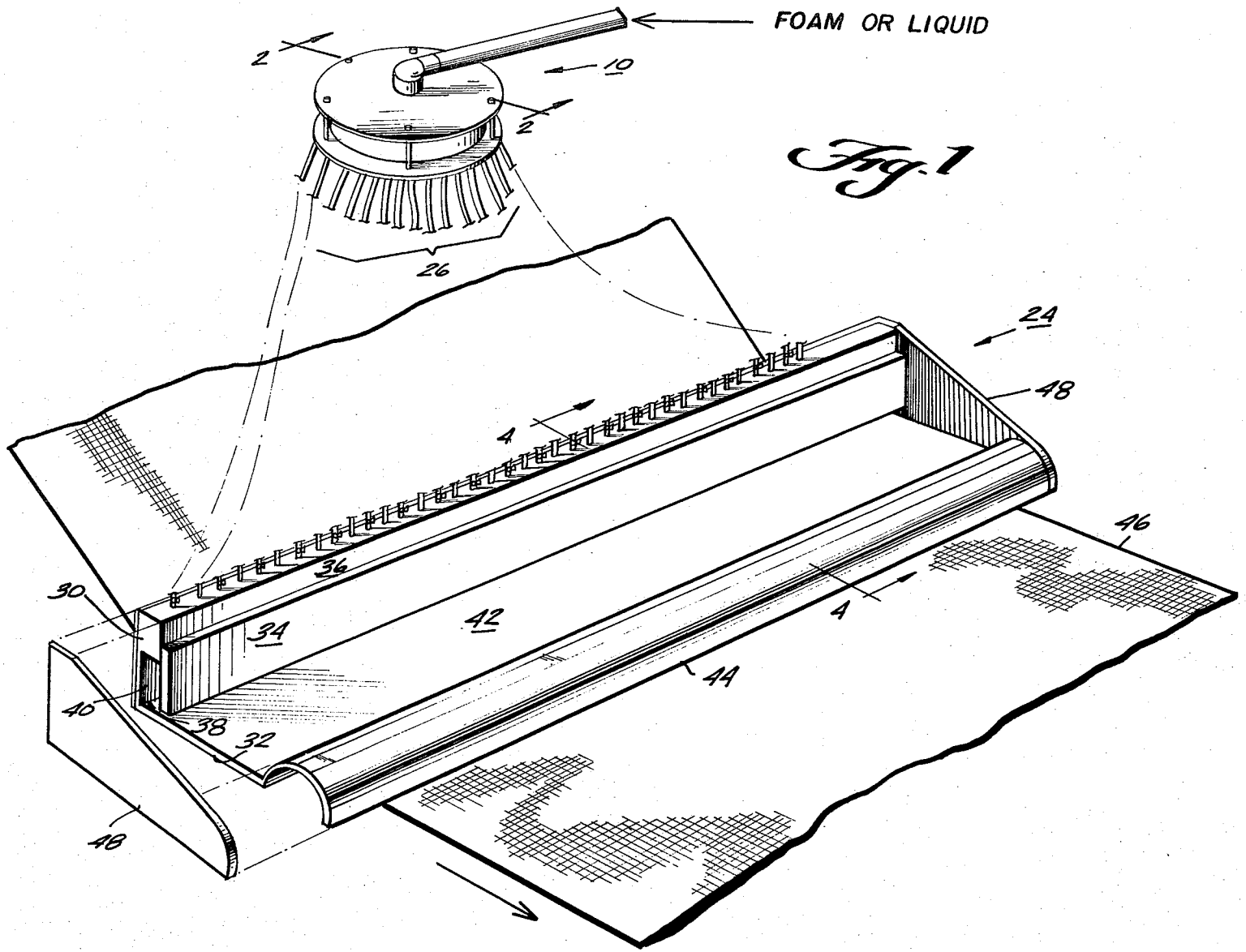
FIG. 1 is a perspective view of a foam distributor and applicator arrangement according to the invention.

Referring to FIG. 1, foam is directed to a distributor 10 from a conventional foamer (not shown) which typically comprises a cylindrical member filled with spherical glass beads, preferably at least 2 mm in diameter. Within the cylinder, further mixing of an air-liquid mixture supplied to the foamer occurs. As a result, the foamer produces a foam suitable for application onto a wide web, such as a carpet. In ordinary practice, the foam includes a dye.

When applying foams to a relatively wide material, a problem experienced is that the applicator often does not have a uniform supply of foam across its width. A reason for this is that foam tends not to move laterally. Therefore, steps must be taken to insure that the foam is substantially level across the entire applicator. This, in part, is accomplished in the present invention by the distributor 10 illustrated in FIGS. 1–3.

Figure 2:
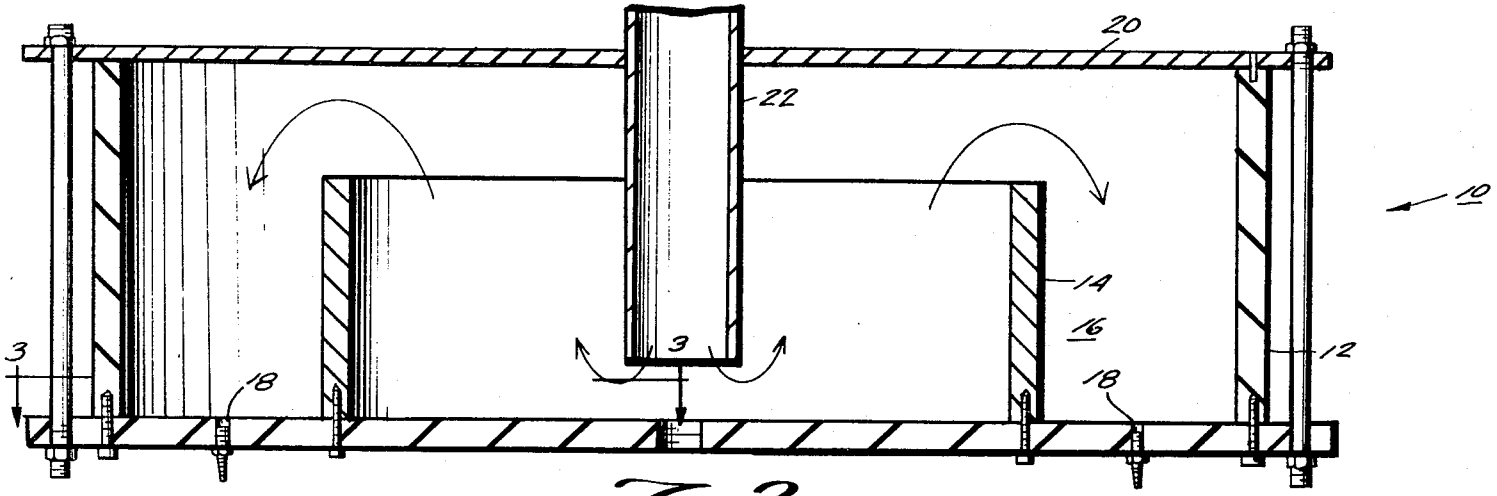
FIG. 2 is an enlarged view in section of the foam distributor, taken along line 2—2 of FIG. 1.
Figure 3:
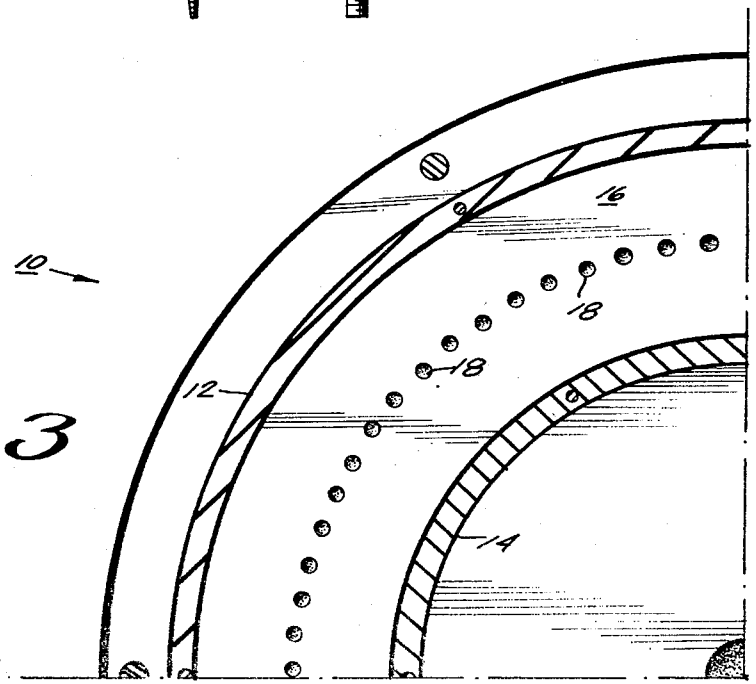
FIG. 3 is a fragmented sectional view of a foam distributor, taken along line 3—3 of FIG. 2.

Referring specifically to FIGS. 2 and 3, the distributor 10 comprises a cylindrical housing 12 containing a further cylindrical member 14 concentric with the axis of the housing but of lesser diameter so as to define an annular space 16 between member 14 and the interior of housing 12. Within space 16, at the bottom of the housing 12, a ring of spaced apertures 18 is provided. For a web of 12 feet width to be coated, approximately 72 of such apertures are employed in distributor 10. The top of housing 12 is covered by a cap 20. A tubular member 22 passes through cap 20 and terminates within the cylindrical member 14 at a location spaced from the bottom of the housing. Member 22 is concentric with housing 12 and member 14, and it has a diameter smaller than that of member 14.

The output of the foamer is connected to tubular member 22 whereby foam under pressure passes downwardly through the tube, upwardly between tube 22 and member 14, and then downwardly between member 14 and the interior of the housing so as to exit from the distributor 10 through apertures 18. Since the housing 12 is sealed, the foam is forced evenly through each of apertures 18.

An applicator 24 is joined to the distributor 10 by means of a plurality of conduits 26 each connected to a separate aperture 18 of the distributor. As can be appreciated from FIGS. 1 and 4, the conduits 26 join the apertures 18 to a corresponding number of passages 28 within an elongated block member 30 which defines a segment of the rear portion of the applicator. Typically, apertures 28 are spaced about 2" apart in an applicator designed for use with a web 12' wide.

The bottom surface of block 30 is spaced from the bottom 32 of the applicator. A further block 34 is slidably joined to the forward surface 36 of block 30 by conventional means (not shown). Block 34 is vertically adjustable with respect to the bottom of the applicator to produce a flow constriction in the form of a gate 30 of adjustable height. By this arrangement, foam passing under pressure through the passages 28 is deposited in the space 40 behind gate 38. The block 34 is adjusted with respect to the bottom wall 32 of the applicator so as to produce a build-up of foam within space 40 whereby the individual streams of foam entering the applicator through passages 28 are combined into a sheet-like foam formation which moves through gate 38 into a trough, or reservoir, 42 lying behind a curved blade 44.

The foam accumulates within trough 42 until it reaches the flattened crest of blade 44. At such time, a thin layer of foam passes over the crest and moves under the force of gravity along the curvature of the blade onto the moving web 46 which is directed past the outer edge of blade 44 normal to the length of trough 42, as shown in FIG. 1. Of course, the foam is retained from flowing out of the ends of trough 42 by caps 48.

The purpose of providing a flattened crest on blade 44 is to facilitate leveling of the apparatus so that a uniform layer of foam will pass the crest and descend along the blade's curvature towards the moving web. Since a variety of conventional means can be utilized for this purpose, no particular leveling arrangement has been illustrated.

An alternative to the gating arrangement illustrated in FIGS. 1 and 4 is shown in FIGS. 5 and 6. More particularly, instead of utilizing a pair of blocks to define a gate so as to convert separate streams of foam into a sheet-like formation for entry into the trough 42 of the applicator, a single block 30' is employed. The block is provided with a pluarlity of spaced passageways 28' arranged in the same manner as described with respect to the previous embodiment. However, the bottom surface of block 30' is spaced proximate to the bottom 32 of the applicator to form a flow constriction, and an elongated slot 50 is provided in the bottom surface of block 30' to intersect each of the passageways 28'. The width of slot 50 is less than the diameters of the passageways, and thus, a constricted opening extending between the passageways is defined by the slot. As a result of the combination of block 30' being proximate to the bottom 32 of the applicator and the passageways 28' being interconnected by the narrow slot 50, the streams of foam moving through passageways 28' combine as a sheet as the foam fills trough 42.

Although the arrangement has been described in connection with the application of foam to a moving web, it is apparent that the same apparatus also is capable of use in a system wherein the supply is a liquid one. In such a case, the distributor 10 will direct the liquid via conduits 26 and passageways 30 (or 30') causing trough 42 to be filled. The overflow from the trough will be directed to the moving web via curved blade 44 in the same manner as foam.

What is claimed is:

1. Apparatus for applying liquid and foam compositions to a moving web, comprising:

a distributor to which said composition is supplied, said distributor being provided with a plurality of outlets;

an applicator joined to said distributor means by a plurality of conduits, each conduit being connected between a respective outlet in said distributor and a respective passageway in said applicator, the passageway being arranged in spaced relationship along one side of an elongated reservoir which forms a portion of said applicator, said applicator further including means for constricting flow of said composition from the passageways into said reservoir whereby individual streams of composition discharged from said passageways are merged into a sheet-like form for passage into said reservoir, said applicator further comprising a curved blade extending along the length of said reservoir on the opposite side thereof from said plurality of passageways, said blade being arranged such that as the reservoir fills with composition, an overflow of said composition passes over the crest of said blade and moves along the blade's curvature to be deposited uniformly across said web as the web moves in a direction normal to the length of said reservoir.

2. Apparatus as set forth in claim 1, wherein said distributor comprises:

a closed cylindrical housing;

a first cylindrical member located within said housing and secured to a bottom of the housing, said first member being dimensioned to define an annular space between the member and the housing, said plurality of outlets comprising spaced apertures arranged in the housing bottom so as to communicate with said annular space; and a second cylindrical member passing through a cap which forms a top of the housing, said second member being concentric with the first cylindrical member and having a lesser diameter than said first member, said second cylindrical member terminating within the first member at a location spaced from the bottom of the housing and being adapted to introduce the composition to the interior of said distributor.

3. Apparatus as set forth in claim 2, wherein said spaced apertures are arranged in a ring in the bottom of the housing.

4. Apparatus as set forth in claim 1, wherein said flow constricting means in said applicator comprises:

a first elongated block member within which said spaced passageways are vertically arranged, said block member being formed such that the bottoms of the passageways are spaced from the bottom of the applicator;

a second elongated block member operatively related to said first block member, and vertically adjustable with respect thereto, to define a gate between the bottom of the second block and the bottom of the applicator whereby streams of composition discharged from the passageways build up behind said gate and pass through the gate in sheet-like form to enter the reservoir.

5. Apparatus as set forth in claim 4, wherein said distributor comprises:

a closed cylindrical housing;

a first cylindrical member located within said housing and secured to a bottom of the housing, said first member being dimensioned to define an annular space between the member and the housing, said plurality of outlets comprising spaced apertures arranged in the housing bottom so as to communicate with said annular space; and a second cylindrical member passing through a cap which forms a top of the housing, said second member being concentric with the first cylindrical member and having a lesser diameter than said first member, said second cylindrical member terminating within the first member at a location spaced from the bottom of the housing and being adapted to introduce the composition to the interior of said distributor.

6. Apparatus as set forth in claim 5, wherein said spaced apertures are arranged in a ring in the bottom of the housing.

7. Apparatus as set forth in claim 1, wherein said flow constricting means in said applicator comprises:

an elongated block member within which said spaced passageways are vertically arranged, said block member being formed such that the bottoms of the passageways are proximate the bottom of the applicator, but are spaced therefrom, said block member being provided in a bottom surface thereof with an elongated slot interconnecting the passageways, said slot being a width less than the diameters of said passageways whereby streams of composition discharged from the passageways build up in the space between the passageways and the applicator bottom and in said slot so as to enter the reservoir in sheet-like form.

8. Apparatus as set forth in claim 7, wherein said distributor comprises:

a closed cylindrical housing;

a first cylindrical member located within said housing and secured to a bottom of the housing, said first member being dimensioned to define an annular space between the member and the housing, said plurality of outlets comprising spaced apertures arranged in the housing bottom so as to communicate with said annular space; and a second cylindrical member passing through a cap which forms a top of the housing, said second member being concentric with the first cylindrical member and having a lesser diameter than said first member, said second cylindrical member terminating within the first member at a location spaced from the bottom of the housing and being adapted to introduce the composition to the interior of said distributor.

9. Apparatus as set forth in claim 8, wherein said spaced apertures are arranged in a ring in the bottom of the housing.

* * * * *